United States Patent [19]

Yamane et al.

[11] Patent Number: 5,044,342

[45] Date of Patent: Sep. 3, 1991

[54] AUTOMOTIVE FUEL INJECTION SYSTEM

[75] Inventors: Kouichi Yamane; Koji Nishimoto; Masanobu Uchinami, all of Hyogo, Japan

[73] Assignee: Mitsubishi Denki Kabushiki Kaisha, Tokyo, Japan

[21] Appl. No.: 625,386

[22] Filed: Dec. 11, 1990

[30] Foreign Application Priority Data

Jan. 23, 1990 [JP] Japan ..... 2-14405

[51] Int. Cl.[5] ..... F02D 41/10

[52] U.S. Cl. ..... 123/492; 123/480; 364/431.07

[58] Field of Search ..... 123/478, 480, 486, 488, 123/492; 364/431.05, 431.07

[56] References Cited

U.S. PATENT DOCUMENTS

| | | | |
|---|---|---|---|
| 4,534,331 | 8/1985 | van Belzen et al. | 123/492 |
| 4,636,957 | 1/1987 | Otobe et al. | 123/492 X |
| 4,643,152 | 2/1987 | Yamato | 123/492 X |
| 4,747,387 | 5/1988 | Takao et al. | 123/492 X |
| 4,929,224 | 3/1990 | Nishiyama et al. | 123/492 |
| 4,951,634 | 8/1990 | Nishizawa et al. | 123/492 |
| 4,962,742 | 10/1990 | Nishizawa et al. | 123/492 |

*Primary Examiner*—Willis R. Wolfe

*Attorney, Agent, or Firm*—Sughrue, Mion, Zinn, Macpeak and Seas

[57] ABSTRACT

An automotive fuel injection system for detecting as quickly as possible the occurrence of acceleration without employing a throttle sensor to thereby perform an asynchronous fuel injection for the purpose of maintaining the air-to-fuel ratio of the combustible air-fuel mixture at an optimum value during the acceleration of the automotive engine. The automotive fuel injection system comprises a device for comparing the pressure inside the fuel intake system with an average value of the pressures inside the fuel intake system. When the pressure prevailing in the fuel intake system deviates by a predetermined quantity from the average pressure inside the fuel intake system, acceleration is deemed as actually occurring in the automotive engine and, hence, asynchronous fuel injection is effected substantially simultaneously with the detection of the occurrence of engine acceleration.

2 Claims, 5 Drawing Sheets

AUTOMOTIVE FUEL INJECTION SYSTEM

BACKGROUND OF THE INVENTION

1. Field of the Invention

The present invention generally relates to a fuel injection system for use in an automotive vehicle and, more particularly, to the fuel injection system for injecting fuel into an automotive fuel intake system during the acceleration of an automotive engine.

2. Description of the Prior Art

It is generally well known that the fuel injection system in an automotive vehicle is designed to inject fuel in a quantity appropriate to the amount of air introduced into a combustion chamber of, for example, an internal combustion engine. During a transit period such as, for example, during the acceleration of the combustion engine, however, it has often been observed that, due to a delay in detecting the amount of air being supplied through the automotive intake system and/or a substantial time required for the fuel injected into the automotive intake system to be actually introduced into the combustion chamber, the ratio of air relative to fuel, hereinafter referred to as an air-to-fuel ratio, of a combustible air-fuel mixture cannot be maintained at an optimum value. Therefore, it is a recommended practice to increase the amount of fuel to be injected into the automotive intake system once acceleration has been detected.

In order that the amount of fuel to be injected can be increased upon the detection of an occurrence of acceleration, it is a generally employed practice to utilize, as a means for detecting the acceleration, a throttle sensor for detecting the opening of a throttle valve disposed in the automotive intake system and for generating an output signal indicative of the opening of the throttle valve at intervals of a predetermined time. According to this conventional practice, the detection of the occurrence of the acceleration is made when the amount of change in the level of the output signal generated from the throttle sensor at intervals of the predetermined time exceeds over a predetermined value, so that an asynchronous injection of fuel into the fuel intake system and then into the combustion chamber can be effected.

The prior art fuel injection system which operates in the above-described manner requires the use of a throttle sensor for the detection of the occurrence of acceleration, resulting in an increase in the manufacturing costs of the system.

SUMMARY OF THE INVENTION

The present invention has been devised with a view to substantially eliminating the above-discussed problems inherent in the prior art automotive fuel injection system and is intended to provide an improved automotive fuel injection system which can effectively detect as quickly as possible the occurrence of acceleration without employing a throttle sensor and can also effectively perform an asynchronous fuel injection thereby maintaining the air-to-fuel ratio of the combustible air-fuel mixture at an optimum value during the acceleration of an automotive engine.

In order to accomplish the above-described object, the present invention provides an improved automotive fuel injection system comprising a means for comparing the pressure inside the fuel intake system with an average value of the pressures inside the fuel intake system.

When the pressure prevailing in the fuel intake system is higher than the average pressure inside the fuel intake system by a predetermined quantity, that is, when the pressure prevailing in the fuel intake system deviates by a predetermined quantity from the average pressure inside the fuel intake system, acceleration is deemed as actually occurring in the automotive engine and, hence, the asynchronous fuel injection is effected substantially simultaneously with the detection of the occurrence of the engine acceleration.

Thus, according to the present invention, the actual occurrence of engine acceleration is detected in terms of the pressure prevailing inside the automotive fuel intake system so that the asynchronous fuel injection can be effected to supply fuel into the automotive intake system.

BRIEF DESCRIPTION OF THE DRAWING

In any event, the present invention will become clearer from the following description of a preferred embodiment thereof, when taken in conjunction with the accompanying drawings. However, the embodiment and the drawings are given only for the purpose of illustration and explanation, and are not to be taken as limiting the scope of the present invention in any way whatsoever, which scope is to be determined solely by the appended claims. In the accompanying drawings, like reference numerals are used to denote like parts throughout the several views, and:

DETAILED DESCRIPTION OF THE EMBODIMENT

Figure 1:
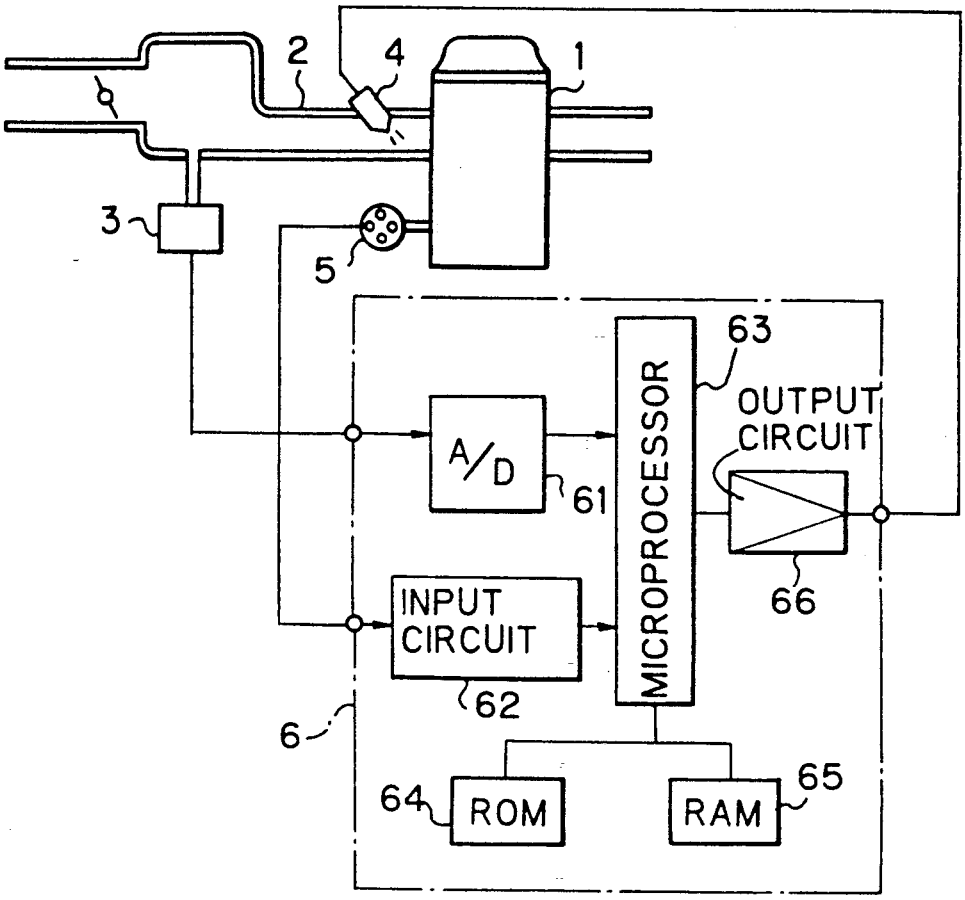
FIG. 1 is a schematic diagram showing an automotive fuel injection system embodying the present invention.

Referring first to FIG. 1, an automotive engine system shown therein comprises a multi-cylinder combustion engine 1 including an exhaust passage, communicated at one end with a plurality of combustion chambers in the combustion engine 1 through an exhaust manifold and at the opposite end to the atmosphere for the emission of exhaust gases therethrough to the atmosphere and a fuel intake passsage 2 communicated at one end with the combustion chambers in the combustion engine 1 through an intake manifold and at the opposite end to the atmosphere for the introduction of air therethrough into the combustion chambers. The fuel intake passage 2 has a well-known throttle valve and a fuel injector 4 in association with each combustion chamber for injecting fuel into the respective combustion chamber in a manner as will be described later, which injector 4 is positioned in the vicinity of an intake port leading to the respective combustion chamber and downstream of the throttle valve with respect to the direction of flow of a combustile air-fuel mixture towards the associated combustion chamber in the engine 1. A generally intermediate portion of the fuel intake passage 2 is fluid-coupled with a pressure sensor 3 of any known construction which feeds an electric output thereof to an analog-to-digital converter 61 included in a control unit 6.

The automotive power plant also comprises a cranking angle sensor 5 for detecting, and generating an electric signal indicative of, the number of revolution of a crankshaft of the combustion engine 1. The electric signal generated by the cranking angle sensor 5 consists of one pulse for each complete revolution of the crankshaft of the combustion engine 1, and this electric signal is supplied to an input circuit 62 also included in the control unit 6.

The control unit 6 is so designed and so configured as to calculate a required amount of fuel to be injected in dependence on the output signals from the pressure sensor 3 and the cranking angle sensor 5, respectively, and then to provide the fuel injectors with a pulse signal of a predetermined pulse width appropriate to a result of the calculation. For this purpose, the control unit 6 comprises, in addition to the analog-to-digital converter 61 and the input circuit 62, a microprocessor 63, a read-only memory (ROM) 64, a random access memory (RAM) 65 and an output circuit 66 connected electrically with each fuel injector 4.

The analog-to-digital converter 61 is operable to convert the analog output signal from the pressure sensor 3 into a digital pressure signal which is in turn supplied to the microprocessor 63. The input circuit 62 is operable to effect a level conversion of the pulse signal from the cranking angle sensor 5 and then to supply its output signal to the microprocessor 63. Upon receipt of the digital pressure signal from the analog-to-digital converter 61 and the cranking angle signal from the input circuit 62, the microprocessor operates to calculate the amount of fuel to be supplied to the combustion engine and then to output a drive pulse of a predetermined pulse width through the output circuit 66 to each fuel injector 4 for driving the latter. The sequence of operation performed by the microprocessor 63 and data required by the microprocessor 63 to execute such a sequence of operation are programmed and stored in the read-only memory 64. The random access memory 65 connected with the microprocessor 63 together with the read-only memory 64 is used to temporarily store data used during the calculation performed by the microprocessor 63. The output circuit 66 is used to drive each fuel injector 4 in dependence on the output signal generated by the microprocessor 63.

The operation of the automotive fuel injection system according to the present invention as applied to a four-cycle 3-cylinder combustion engine designed to inject fuel into the combustion chambers simultaneously will now be described with particular reference to FIGS. 2 to 4 which illustrate flowcharts of the sequence of operation thereof.

Figure 2:
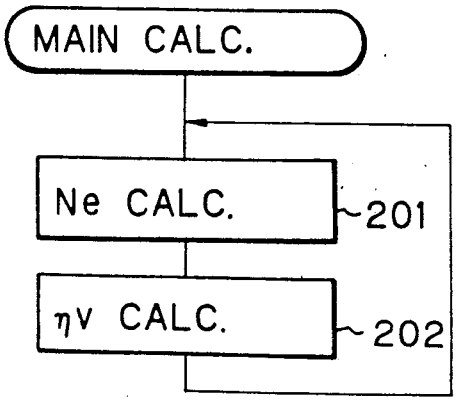
FIGS. 2 to 4 are flowcharts showing the sequence of operation of the automotive fuel injection system according to the present invention.
Figure 4:
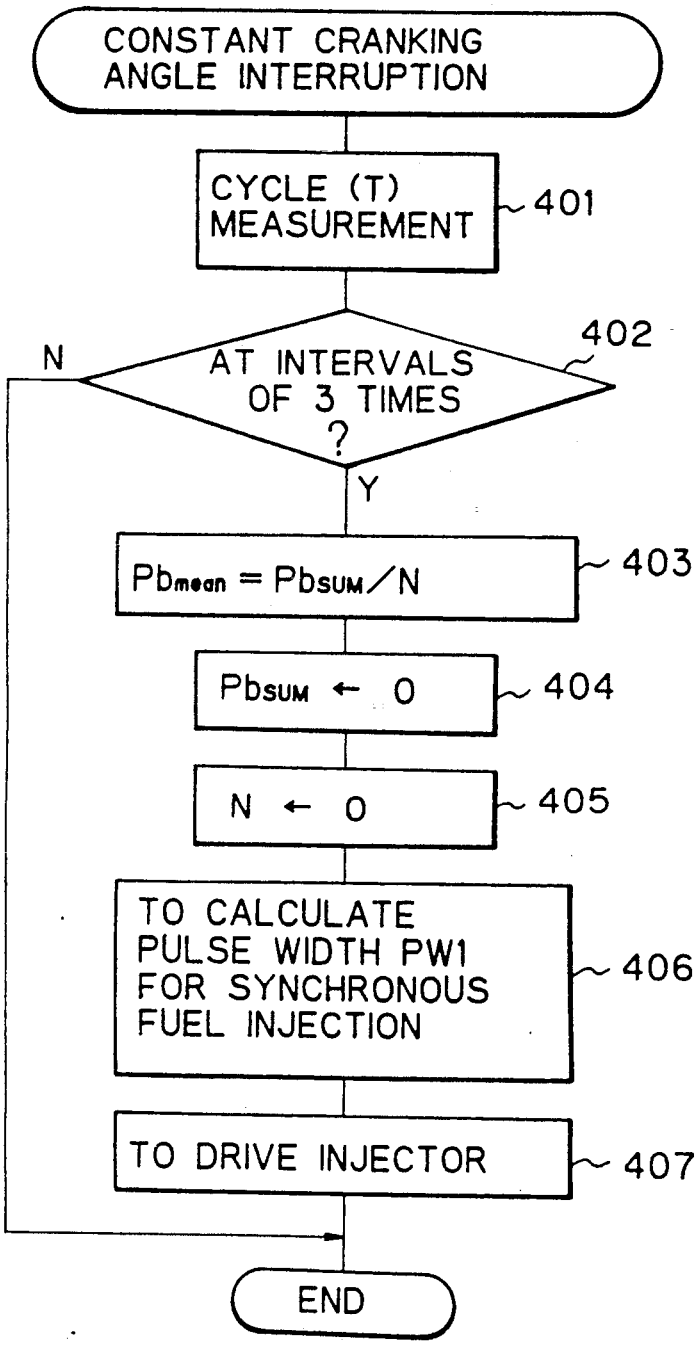
Figure 5:
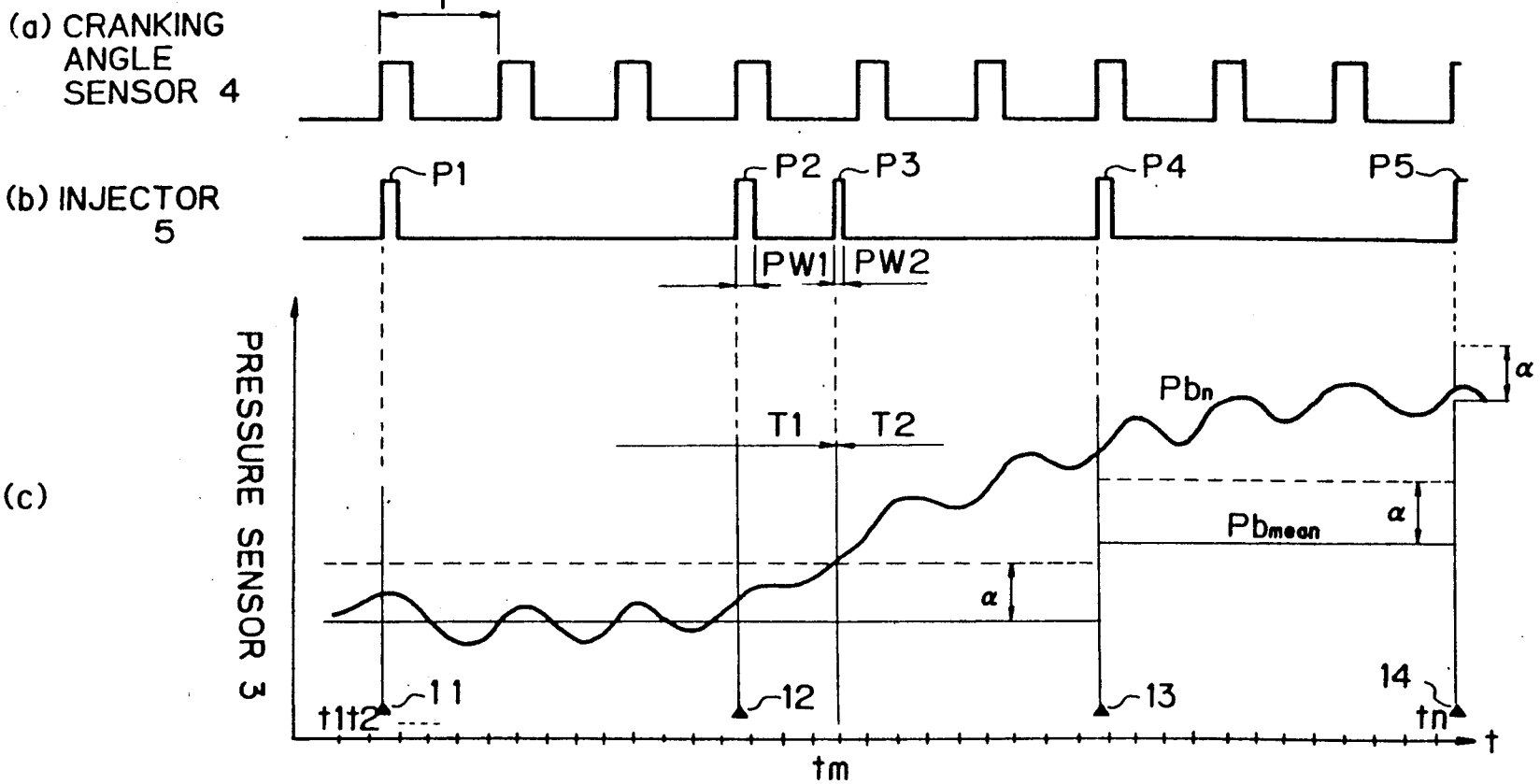
FIG. 5 is a timing chart showing a timed relationship between respective output signals from various sensors and the operation of the automotive fuel injection system according to the present invention.

Referring first to FIG. 2 showing a main calculation flow of the program stored in the read-only memory 64, subsequent to the start of a main calculation, the number of revolutions Ne of the combustion engine is calculated at "Ne Calc" step 201 in reference to the cycle T of the cranking angle signal (the waveform of which is shown by (a) in FIG. 5) which has been measured at "T Measurement" step 401 of a constant cranking angle interruption process by the cranking angle sensor 5 shown in FIG. 4. At subsequent "Volume Efficiency Calc" step 202, the value of a volume efficiency $\eta v$ stored in the read-only memory 64 is calculated by interpolation based on the number of revolutions Ne of the combustion engine determined at the previous step 201 and the pressure Pbn (see waveform (c) shown in FIG. 5) inside the fuel intake passage.

Figure 3:
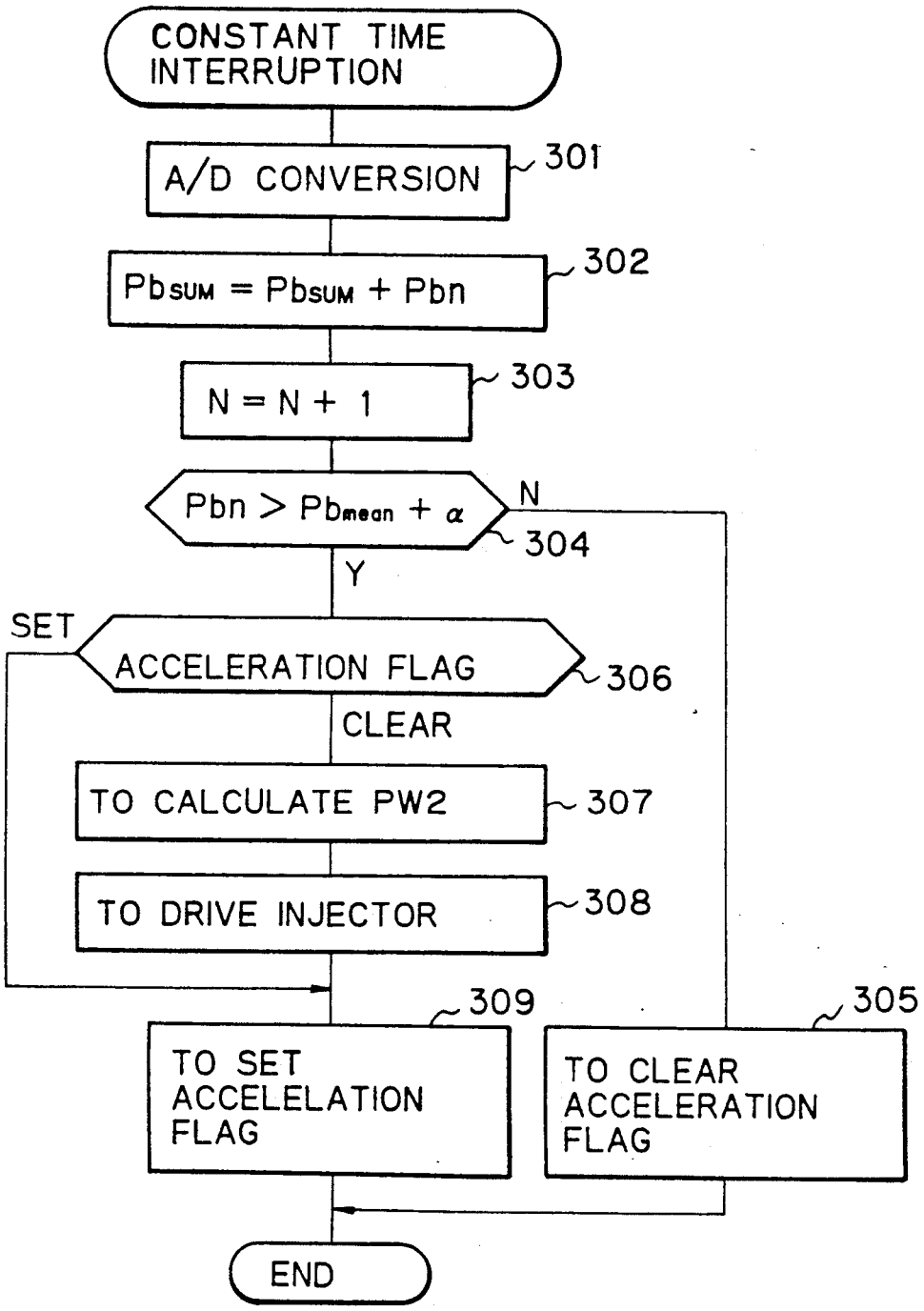

FIG. 3 illustrates a constant time interruption process performed by a timer, i.e., a flow during which interruption for a predetermined time is carried out by a timer. Referring to this constant time interruption process shown therein, the analog pressure signal from the pressure sensor 3 is converted into a digital pressure signal indicative of the pressure Pbn inside the fuel intake passage at intervals of a predetermined time, for example, 5 millisecond, at "Pbn A/D Conversion" step 301. At subsequent "$Pb_{SUM}=Pb_{SUM}=Pbn$" step 302, the digital pressure signal Pbn from the pressure signal 3 is integrated so that the average value $Pb_{mean}$ (shown in a waveform (c) of FIG. 5) of the pressure signals from the pressure sensor 3 which have been converted into the respective digital pressure signals can be calculated at "$Pb_{mean}=Pb_{SUM}/N$" step 403 shown in FIG. 4.

The program flow then goes to "N=N=1" step 303 at which the count value N of a counter operable to count the number of analog-to-digital conversions which is carried out at "Pbn A/D Conversion" step 301 is incremented by one so that, as is the case with the previous step 302, the average value $Pb_{mean}$ of the pressure signals from the pressure sensor 3 which have been converted into the respective digital pressure signals can be calculated at "$Pb_{mean}=Pb_{SUM}/N$" step 403 shown in FIG. 4. Thereafter, the microprocessor 63 compares the digital pressure signal Pbn with the sum of the average value $Pb_{mean}$ of the digital pressure signals and a predetermined value $\alpha$ (shown in the waveform (c) of FIG. 5) to determine if the combustion engine is accelerated. In the event that the digital pressure signal Pbn is lower than the sum of the average value $Pb_{mean}$ of the digital pressure signals and the predetermined value $\alpha$, the microprocessor 63 does not determine that the combustion engine is accelerated as indicated by a period T1 in the waveform (c) of FIG. 5 and, therefore, the program flow goes to step 304 at which an acceleration flag is cleared, followed by termination of the program flow of FIG. 3.

On the other hand, in the event that the digital pressure signal Pbn is higher than the sum of the average value $Pb_{mean}$ of the digital pressure signals and the predetermined value $\alpha$, the microprocessor 63 does determine that the combustion engine is accelerated at a timing tm shown in the waveform (c) of FIG. 5 and, therefore, the program flow goes to step 306 at which another decision is made to determine if the combustion has been previously accelerated. Where the result of the decision at step 306 indicates that the combustion engine has been previously accelerated, the program flow goes to step 309, but where it indicates that the combustion engine has not been previously accelerated, the program flow goes to "PW2 Calc" step 307 at which the pulse width PW2 (see a pulse P3 shown in a waveform (b) of FIG. 5) of a drive pulse for driving the injector 4 to accomplish an asynchronous fuel injection is calculated. Subsequent to "PW2 Calc" step 307, the fuel injector 4 is driven in response to the drive pulse at "Injector Driven" step 308 to supply the fuel into the combustion engine, followed by the setting of the acceleration flag at step 309 before the program flow terminates.

It is to be noted that, in the waveform (b) of FIG. 5, reference characters P1, P2, P4 and P5 represents respective periods during which the fuel injector is driven to accomplish the synchronous fuel injection while reference character P3 represents the period during which the fuel injector is driven to accomplish the asynchronous fuel injection. It is also to be noted that, in the waveform (c) of FIG. 5, reference numerals 11, 12, 13 and 14 represent respective timings at which the average value of the digital pressure signals are calculated and reference characters t1, t2 to tn through tm represent respective timings at which interruption takes place for a predetermined time.

Referring to the flow of FIG. 4, the cycle T of the cranking angle signals supplied from the cranking angle sensor 5 is measured, which is subsequently used for the calculation of the number of revolution Ne at step 201 of the flow of FIG. 2. Then, at decision step 402, the microprocessor determines if the constant cranking angle interruption process takes place at the timing of fuel injection. If the microprocessor determines that it does not, the program flow terminates, but if it determines that it does, the program flow goes to "$Pb_{mean}=Pb_{SUM}/N$" step 403. At "$Pb_{mean}=Pb_{SUM}/N$" step 403, the integrated value $Pb_{SUM}$ of the digital pressure signal originating from the pressure sensor 3 and determined at step 302 in the flow in FIG. 3 is divided by the number N of the analog-to-digital conversion subjected to the pressure signal from the pressure sensor 3 to provide the average value $Pb_{mean}$ of the digital pressure signals. Since the current calculation of the average value $Pb_{mean}$ has been completed, the program flow then goes to decision step 404 at which the integrated value $Pb_{SUM}$ is cleared, followed by step 405 at which the count value N of the counter for counting the number of integration performed to the digital pressure signals is cleared. Then, at step 406, the pulse width PW1 (see the waveform (b) of FIG. 5) of the drive pulse for driving the injector for accomplishing the synchronous fuel injection is calculated on the basis of the digital pressure signal Pbn determined at step 301 of the flow of FIG. 3 and the volume efficiency $\eta v$ determined at step 202 of the flow of FIG. 2 and , thereafter, the injector 4 is driven in response to the drive pulse of the calculated pulse width to effect the supply of fuel into the combustion engine 1, thereby terminating the program flow.

Figure 6:
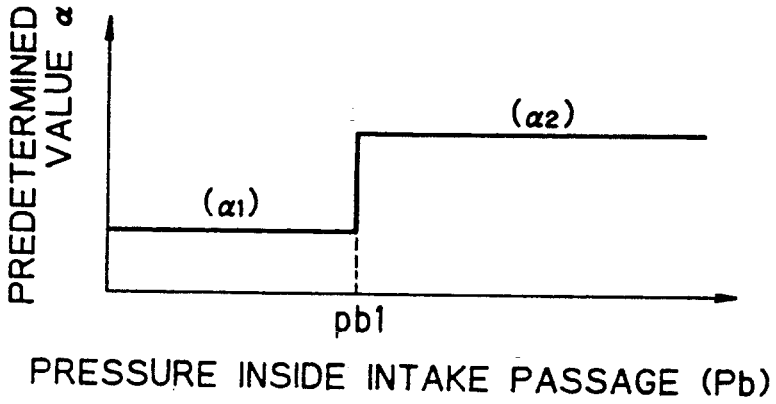
FIGS. 6 and 7 are graphs showing modified forms of setting a predetermined value, respectively, which may be employed in the practice of the present invention.

In the foregoing illustrated embodiment the predetermined value $\alpha$ used at step 304 of the flow of FIG. 3 for the determination of the acceleration taking place in the combustion engine has been described as a constant value. However, if the predetermined value $\alpha$ is reduced to a smaller value as shown by $\alpha 1$ in FIG. 6 when the pressure Pb inside the fuel intake passage is relatively low and increased to a greater value as shown by $\alpha 2$ in FIG. 6 when the pressure Pb inside the fuel intake passage is relatively high, a quick detection of the occurrence of the engine acceleration can be achieved with a low pressure side in which a pressure ripple inside the fuel intake passage is relatively small and any possible erroneous detection of the occurrence of the engine acceleration can be achieved with a high pressure side in which the pressure ripple inside the fuel intake passage is relatively large. It is to be noted that reference character Pb1 used in FIG. 6 represents a reference pressure inside the fuel intake passage which is used as the criterion at which the predetermined value $\alpha$ is switched over between the values $\alpha 1$ and $\alpha 2$.

Figure 7:
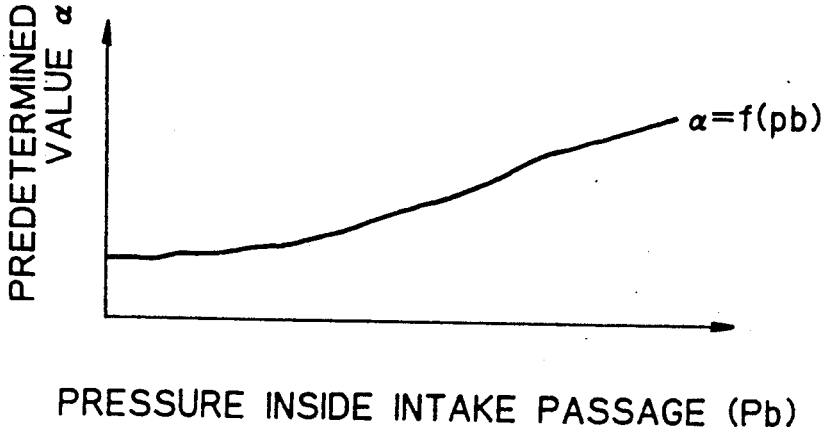

Also, if the predetermined value $\alpha$ used at step 304 of the flow of FIG. 3 is chosen to be equal to f(Pb) as shown in FIG. 7, the predetermined value $\alpha$ can take any value appropriate to the ripple occurring inside the fuel intake passage from the low pressure side to the high pressure side, thus enabling the system to quickly detect the occurrence of the engine acceleration over an entire range of engine operating conditions.

Thus, the present invention having been fully described is effective to detect the occurrence of the acceleration in the combustion engine with the use of only the pressure sensor and with no need to use any throttle sensor, to accomplish the asynchronous fuel injection at the time of occurrence of the engine acceleration. This feature contributes to a reduction in manufacturing cost while providing a highly cost effective automotvie fuel injection system.

Although the present invention has been fully described in connection with the preferred embodiments thereof with reference to the accompanying drawings which are used only for the purpose of illustration, those skilled in the art will readily conceive numerous changes and modifications within the framework of obviousness upon reading the specification of the present invention herein presented. for example, although in describing the present invention reference is made to the 4-cycle 3-cylinder internal combustion engine, the present invention is equally applicable to a combustion engine having at least one cylinder and, hence, at least one combustion chamber.

Accordingly, such changes and modifications are, unless they depart from the spirit and scope of the present invention as delivered from the claims annexed hereto, to be construed as being included therein.

What is claimed is:

1. A fuel injection system for use in association with an automotive combustion engine designed to effect an injection of fuel into a combustion engine in synchronism with a signal generated each time a predetermined cranking angle is attained or at each ignition timing by calculating the amount of fuel to be injected through detection of a pressure inside a fuel intake system of the combustion engine, said system comprising:

a pressure detecting means for detecting the pressure inside the fuel intake system of the combustion engine; and a control means operable to calculate an average pressure value by averaging output signals generated by the pressure detecting means and also to determine that the combustion engine is being accelerated in the event that the output signal generated by the pressure detecting means deviates from the average pressure value by a quantity equal to or greater than a predetermined value, thereby to effect an asynchronous fuel injection in the event that the combustion engine is deemed to have accelerated.

2. A fuel injection system for use in an automotive power plant including a combustion engine having at least one combustion chamber, which comprises:

a fuel injector means for injecting fuel into the combustion chamber at a predetermined timing synchronized with an ignition timing;

a pressure sensor for detecting a pressure inside a fuel intake passage communicating with the combustion chamber and providing a pressure signal; and a control system including an averaging means adapted to receive the pressure signal from the pressure sensor for calculating an average pressure of the pressure signals supplied from the pressure sensor during cycles of operation of the combustion engine, a detecting means for comparing the pressure signal, supplied from the pressure sensor during a certain cycle of operation of the combustion engine, with the average pressure calculated by said averaging means, and a pulse generating means for generating a drive pulse for driving the fuel injector means to effect an injection of fuel into the combustion chamber in the event that the pressure signal supplied by the pressure sensor during said certain cycle of operation of the combustion engine deviates from the average pressure by a quantity equal to or higher than a predetermined amount, signifying an occurrence of acceleration of the combustion engine.

* * * * *